US008511983B2

(12) United States Patent
Weinstein et al.

(10) Patent No.: US 8,511,983 B2
(45) Date of Patent: Aug. 20, 2013

(54) LPC EXIT GUIDE VANE AND ASSEMBLY

(75) Inventors: Jess A. Weinstein, Portland, ME (US); Kevin C. Eckland, Kennebunk, ME (US)

(73) Assignee: United Technologies Corporation, Hartford, CT (US)

( * ) Notice: Subject to any disclaimer, the term of this patent is extended or adjusted under 35 U.S.C. 154(b) by 1782 days.

(21) Appl. No.: 12/070,466

(22) Filed: Feb. 19, 2008

(65) Prior Publication Data

US 2009/0208332 A1 Aug. 20, 2009

(51) Int. Cl.
*F01D 1/02* (2006.01)

(52) U.S. Cl.
USPC ..... 415/209.3; 415/209.2; 415/136

(58) Field of Classification Search
USPC ..... 415/134, 136, 137, 139, 208.2, 209.4, 415/211.2; 29/889.22
See application file for complete search history.

(56) References Cited

U.S. PATENT DOCUMENTS

| | | | | |
|---|---|---|---|---|
| 2,632,397 | A | 3/1953 | Jandasek | |
| 3,351,319 | A | 11/1967 | Frost | |
| 3,532,437 | A * | 10/1970 | Strub | 415/136 |
| 4,492,517 | A * | 1/1985 | Klompas | 415/139 |
| 4,820,120 | A | 4/1989 | Feuvrier et al. | |
| 4,827,588 | A | 5/1989 | Meyer | |
| 4,832,568 | A | 5/1989 | Roth et al. | |
| 5,411,370 | A | 5/1995 | Varsik | |
| 5,554,001 | A * | 9/1996 | Boyd et al. | 415/209.2 |
| 6,343,912 | B1 | 2/2002 | Manteiga et al. | |
| 6,409,472 | B1 | 6/2002 | McMahon et al. | |
| 6,543,995 | B1 | 4/2003 | Honda et al. | |
| 6,932,568 | B2 | 8/2005 | Powis et al. | |
| 2003/0185673 | A1 | 10/2003 | Matsumoto et al. | |
| 2007/0140857 | A1 | 6/2007 | Booth et al. | |
| 2009/0191053 | A1 * | 7/2009 | Bridge et al. | 415/208.2 |

FOREIGN PATENT DOCUMENTS

| | | | |
|---|---|---|---|
| EP | 1596036 | A1 | 11/2005 |
| GB | 678085 | | 8/1952 |
| GB | 678085 | A * | 8/1952 |

OTHER PUBLICATIONS

Official Search Report of the European Patent Office in counterpart foreign Application No. EP08254064 filed Feb. 19, 2008.

* cited by examiner

*Primary Examiner* — Nathaniel Wiehe
*Assistant Examiner* — Joshua R Beebe
(74) *Attorney, Agent, or Firm* — Kinney & Lange, P.A.

(57) ABSTRACT

A vane for a gas turbine engine includes an airfoil portion, a platform, and a first flange. The airfoil portion has first and second ends spaced apart in a first direction, and the first end of the airfoil portion defines an unshrouded tip. The platform is integrally formed at the second end of the airfoil, and is configured to define a flowpath boundary segment. The first flange extends from the platform away from the airfoil portion. The first flange defines a first circumferential extension and an adjacent second circumferential extension, each defining forward and aft faces. The first and second circumferential extensions are offset in a second direction such that the forward face of the first circumferential extension is substantially aligned with the aft face of the second circumferential extension in the second direction.

18 Claims, 7 Drawing Sheets

LPC EXIT GUIDE VANE AND ASSEMBLY

BACKGROUND

The present invention relates to vanes and vane assemblies for use with gas turbine engines.

Known vane (or stator) assemblies, such as low pressure compressor (LPC) exit guide vane assemblies for gas turbine engines, often include an inner shroud ring, and outer shroud ring, and a plurality of vane details having airfoils that bridge an annular gap between the inner and outer shroud rings in a cascade configuration. In some designs, an inner end of each vane detail includes a platform that is riveted to the inner shroud ring. An outer end of each vane detail lacks a platform like the inner end, but instead has a "free" end that is potted within an opening in the outer shroud using a "slug" of conformable material (e.g., rubber, etc.). Potting the outer ends of the vane details facilitates assembly processes, and provides a damping effect during engine operation. Clips or other retainers are sometimes also used to retain the potted ends of the vane details relative to a shroud. The riveted connection is often located at the inner shroud ring and the potted connection at the outer shroud ring, because some engine designs provide a more secure and desirable mounting arrangement relative to the engine structural frame at the inner shroud location.

However, the amount of space available for securing the platforms of the vane details is limited, particularly at the inner shroud. In order to provide large numbers of vane details, that is, to provide a high vane count, the vane detail platforms have been positioned next to each other in close proximity in a nested configuration. Yet, there are still limits on how closely adjacent vane platforms can be positioned before interfering with each other and raising problems with structural integrity. For instance, there are generally minimum requirements for a distance provided between rivets and an adjacent edge of a riveted part to maintain structural integrity during engine assembly and operation. In short, known nested designs are not readily scaled to allow any number of vanes within a given vane assembly in an engine, but rather face maximum vane count limits.

The present invention provides an alternative vane and vane assembly configuration that allows for relatively high vane counts.

SUMMARY

A vane for a gas turbine engine includes an airfoil portion, a platform, and a first flange. The airfoil portion has first and second ends spaced apart in a first direction, and the first end of the airfoil portion defines an unshrouded tip. The platform is integrally formed at the second end of the airfoil, and is configured to define a flowpath boundary segment. The first flange extends from the platform away from the airfoil portion. The first flange defines a first circumferential extension and an adjacent second circumferential extension, each defining forward and aft faces. The first and second circumferential extensions are offset in a second direction such that the forward face of the first circumferential extension is substantially aligned with the aft face of the second circumferential extension in the second direction.

DETAILED DESCRIPTION

In general, the present invention provides a vane (or stator) and an assembly thereof for use in a gas turbine engine. Each vane includes an integrally formed platform with a flange configured for attachment with an adjacent, similarly-configured vane in a shiplap joint.

Figure 1:
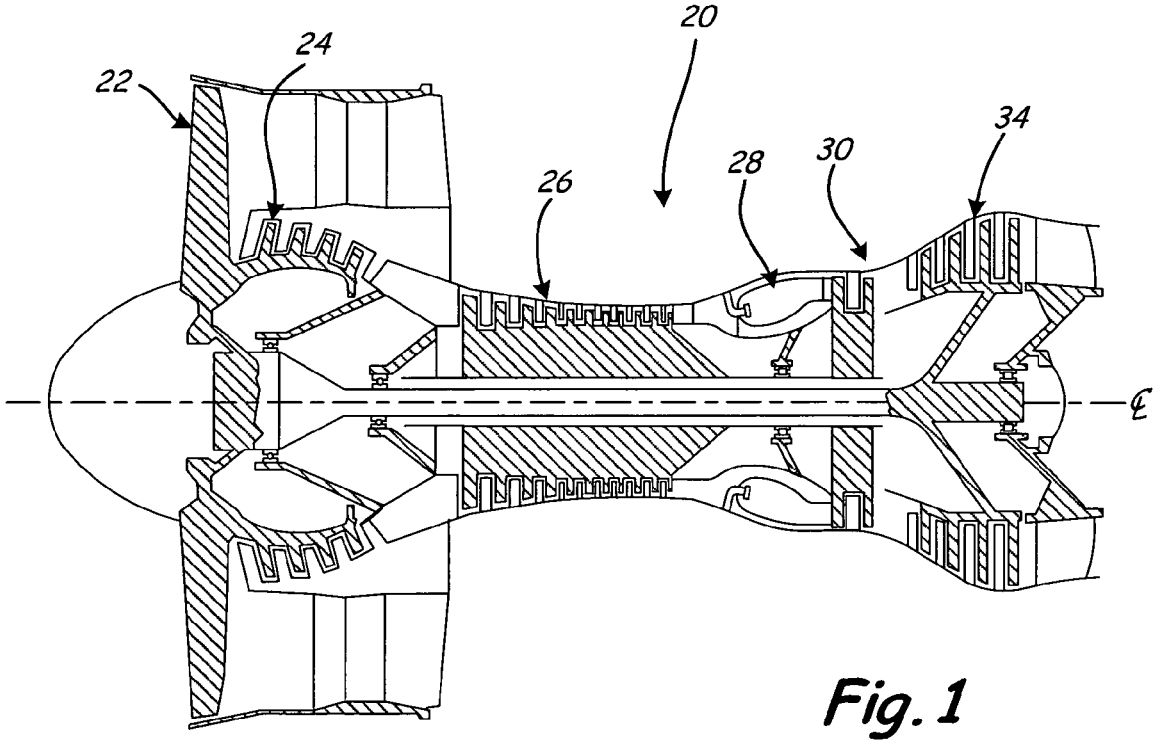
FIG. 1 is a schematic cross-sectional view of a gas turbine engine.

FIG. 1 is a schematic cross-sectional view of an exemplary two-spool gas turbine engine 20. The engine 20 includes a fan 22, a low-pressure compressor (LPC) section 24, a high-pressure compressor (HPC) section 26, a combustor assembly 28, a high-pressure turbine (HPT) section 30, and a low-pressure turbine (LPT) section 34 all arranged about an engine centerline $C_L$. The general construction and operation of gas turbine engines is well-known in the art, and therefore further discussion here is unnecessary. It should be noted, however, that the engine 20 is shown in FIG. 1 merely by way of example and not limitation. The present invention is also applicable to a variety of other gas turbine engine configurations. For example, the engine 20 can include gearing between the fan 22 and the LPC section 24 not shown in FIG. 1.

Figure 2:
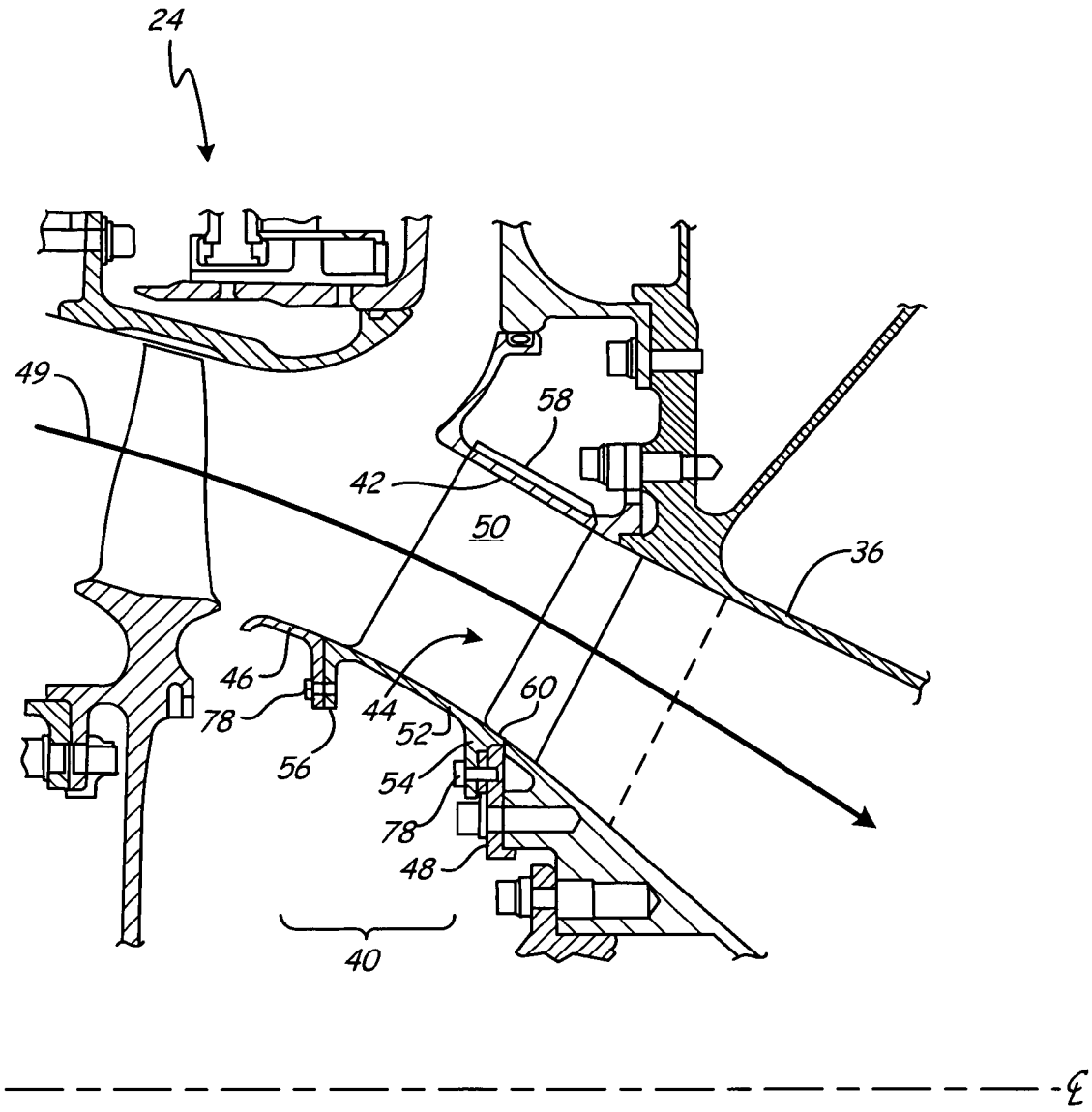
FIG. 2 is a cross-sectional view of a portion of the gas turbine engine, showing a low pressure compressor exit guide vane assembly according to the present invention.

FIG. 2 is a cross-sectional view of a portion of the gas turbine engine 20 at an aft region of the LPC section 24 upstream from an intermediate case 36 and the HPC section 26 (not visible in FIG. 2). A LPC exit guide vane assembly 40 is shown at the aft end of the LPC section 24. The assembly 40 includes an outer diameter (OD) shroud ring 42, a plurality of vanes 44 arranged about the engine centerline $C_L$ in a cascade configuration, an upstream (or forward) ring 46, and a downstream (or aft) ring 48. A generally annular primary flowpath, represented schematically by arrow 49, is defined through the LPC exit guide vane assembly 40, with an OD boundary of the primary flowpath 49 defined by the OD shroud ring 42.

Figure 3:
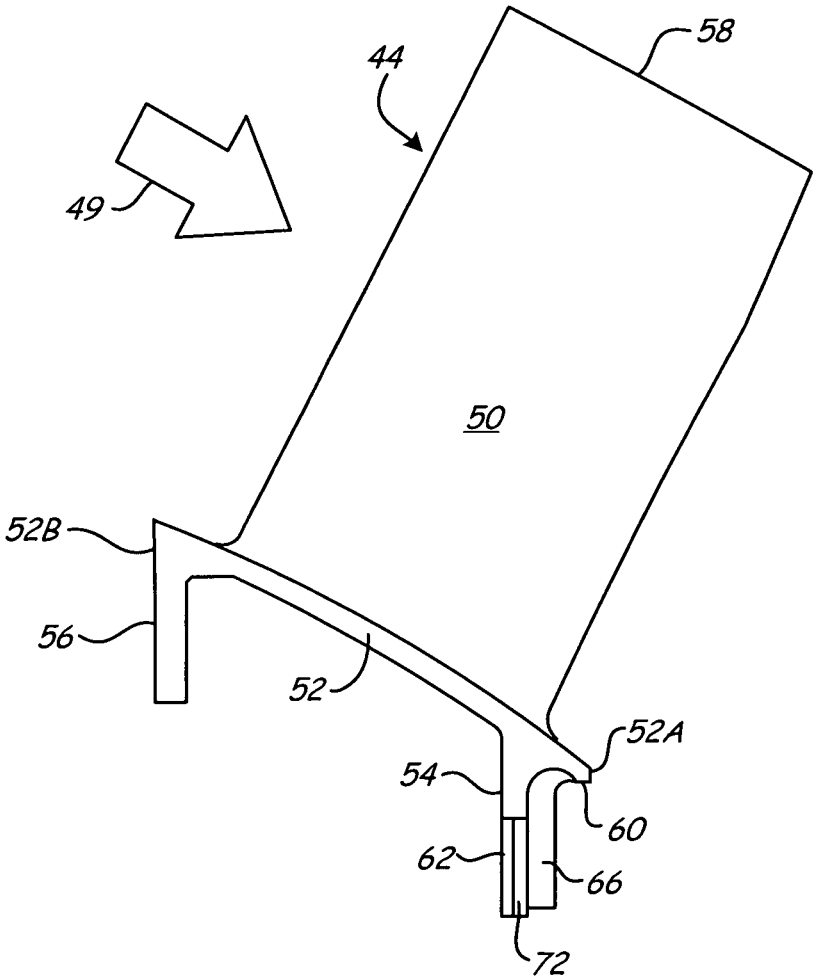
FIG. 3 is a side view of a vane of the vane assembly of FIG. 2.
Figure 4:
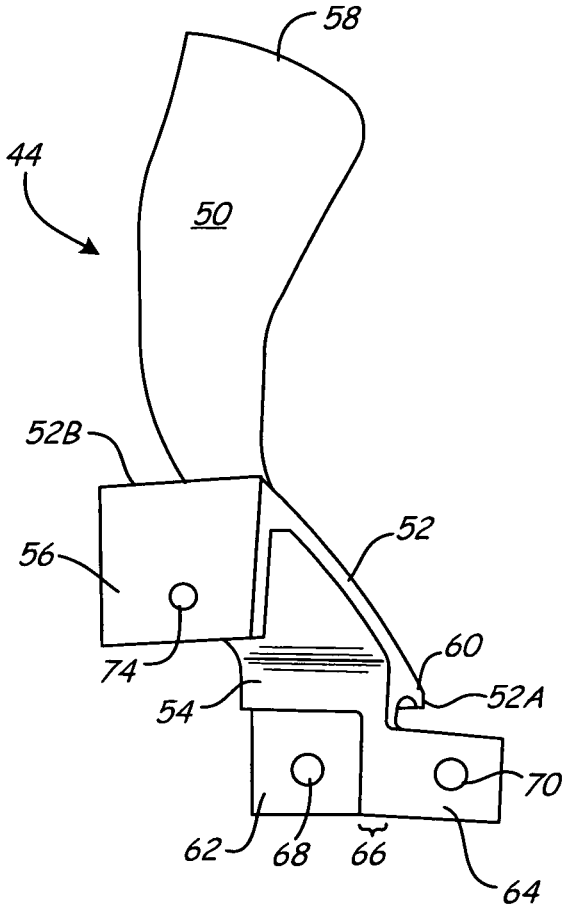
FIG. 4 is a front view of the vane of FIG. 3.
Figure 5:
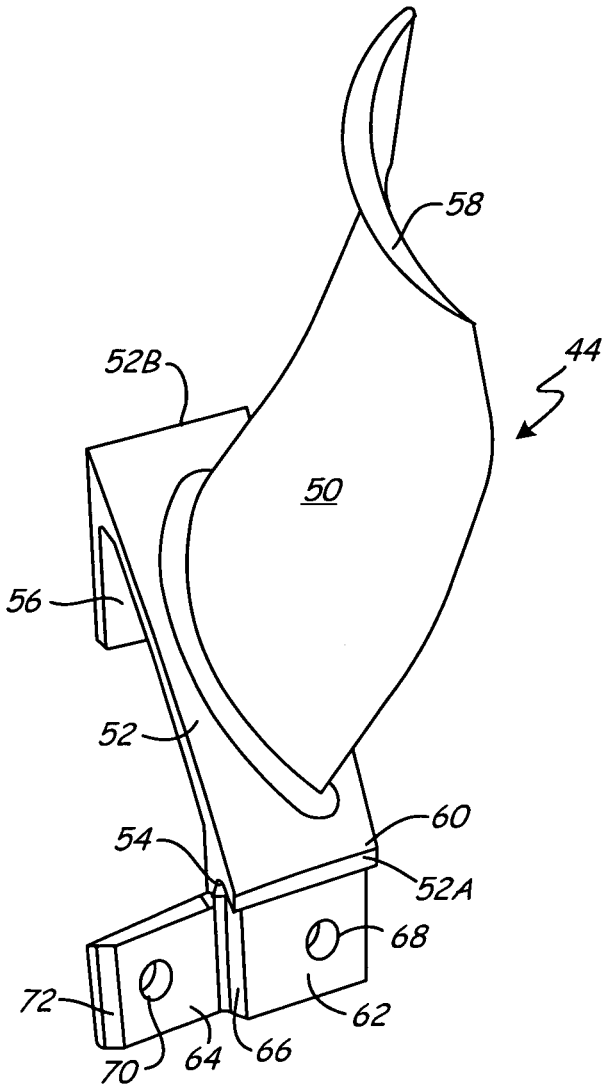
FIG. 5 is an isometric view of the vane of FIGS. 3 and 4.

FIGS. 3-5 illustrate one vane 44 for use with the LPC exit guide vane assembly 40. FIG. 3 is a side view of the vane 44, FIG. 4 is a front view of the vane 44, and FIG. 5 is an isometric view of the vane 44. In the illustrated embodiment, the vane 44 includes an airfoil portion 50, a platform 52, a first flange 54 and a second flange 56. Each vane can be made of metallic materials such as titanium, nickel, cobalt, aluminum, etc. and alloys containing such metals. The vanes 44 can be fabricated using known processes such as casting, forging, machining, etc. Coatings (not specifically shown) can be applied to portions of the vanes 44 as desired.

The airfoil portion 50 has an aerodynamic curvature (e.g., a three-dimensional "bowed" profile) to interact with fluid passing along the primary flowpath 49 through the LPC section 24. The airfoil portion 50 has a free end (or tip) 58, that is, an end without an integral shroud or platform. In the illustrated embodiment, the free end 58 of the airfoil portion 50 is configured to be inserted into a slot in the OD shroud ring 42 and potted with a conformable material (e.g., rubber) in a conventional manner. In that respect, the free end 58 of the airfoil portion 50 is positioned radially outward in the LPC exit guide vane assembly 40 (see FIG. 2).

The platform 52 is arranged at an opposite end of the airfoil portion 50 from the free end 58, and can have a parallelogram-shaped profile. The platform 52 can be positioned radially inward in the LPC exit guide vane assembly 40, as shown in FIG. 2, to define a segment of an inner diameter (ID) boundary of the primary flowpath 49. The airfoil portion 50 is integrally formed with platform 52. The platform 52 can define a lip 60 at a downstream edge 52A to provide sealing or other functionality, as explained further below.

The first and second flanges 54 and 56 both extend from the platform 52 away from the airfoil portion 50, that is, in a radially inward direction. The first and second flanges 54 and 56 can both be configured to be substantially perpendicular to the engine centerline $C_L$ when the vane 44 is installed in the LPC exit guide vane assembly 40 of the engine 20.

The first flange 54 is arranged adjacent to the lip 60 at the downstream edge 52A of the platform 52, and can be integrally formed with the platform 52. The first flange 54 includes a first circumferential extension 62 and a second circumferential extension (or lobe) 64. The first and second circumferential extensions 62 and 64 meet at a central portion 66. Openings 68 and 70 are located in the first and second circumferential extensions 62 and 64, respectively, which enable the first flange 54 to be secured to the downstream ring 48 with suitable fasteners, such as rivets (see FIGS. 2 and 7).

In the illustrated embodiment, the first circumferential extension 62 is integrally joined to the platform 52 along an entire radially outward extent of the first circumferential extension 62, and is generally circumferentially aligned with platform 52. The central portion 66 is positioned at a circumferential edge of the platform 52, and the second circumferential extension extends from the central portion 66 beyond the circumferential edge of the platform 52 in a cantilevered configuration. The first and second circumferential extensions 62 and 64 are both substantially planar. However a chamfered edge 72 is provided at a distal end of the cantilevered second circumferential extension 64 at an aft face thereof.

A cutaway portion is defined in the first flange 54 at a forward face of the first circumferential extension 62. The cutaway portion at the first circumferential extension 62 has a shape that corresponds to that of the second circumferential extension 64. In the illustrated embodiment, the cutaway portion extends to a radially inward edge of the first circumferential extension 62 but its radially outward extent does not reach the platform 52. A depth of the cutaway portion (measured in the axial direction) at the first circumferential extension 62 can be at least as great as a thickness of the second circumferential extension 64 (measured in the axial direction), with a thickness of the central portion 66 being equal to a total distance between an aft face of the first circumferential extension 62 and a forward face of the second circumferential extension 64.

The first flange 54 is configured to form a shiplap joint when engaged with an adjacent vane 44 of similar configuration, as explained further below. In this respect, the first and second circumferential extensions 62 and 64 are axially offset, such that the forward face of the first circumferential extension 62 within the cutaway portion is substantially axially aligned (i.e., co-planar) with the aft face of the second circumferential extension 64.

The second flange 56 is arranged at an upstream edge 52B of the platform opposite the first flange 54, and in the illustrated embodiment is substantially planar, with a substantially rectangular profile, and axially aligned with the upstream edge 52A. Circumferential edges of the second flange 56 are aligned with the circumferential edges of the platform 52 in the illustrated embodiment. The second flange 56 includes an opening 74, enabling the second flange 56 to be secured to the upstream ring 46 with a suitable fastener, such as a rivet (see FIG. 2). The second flange 56 can be integrally formed with the platform 52.

Figure 6:
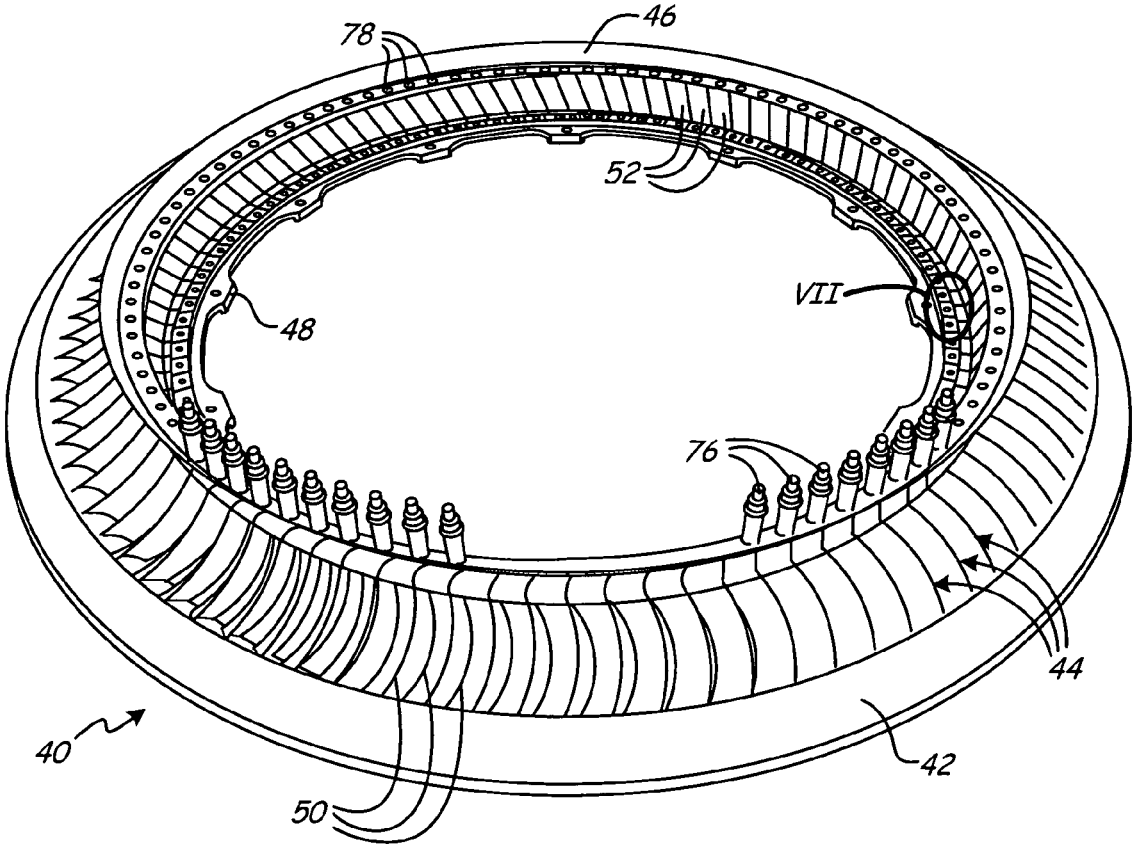
FIG. 6 is a perspective view of the low pressure compressor exit guide vane assembly.
Figure 7:
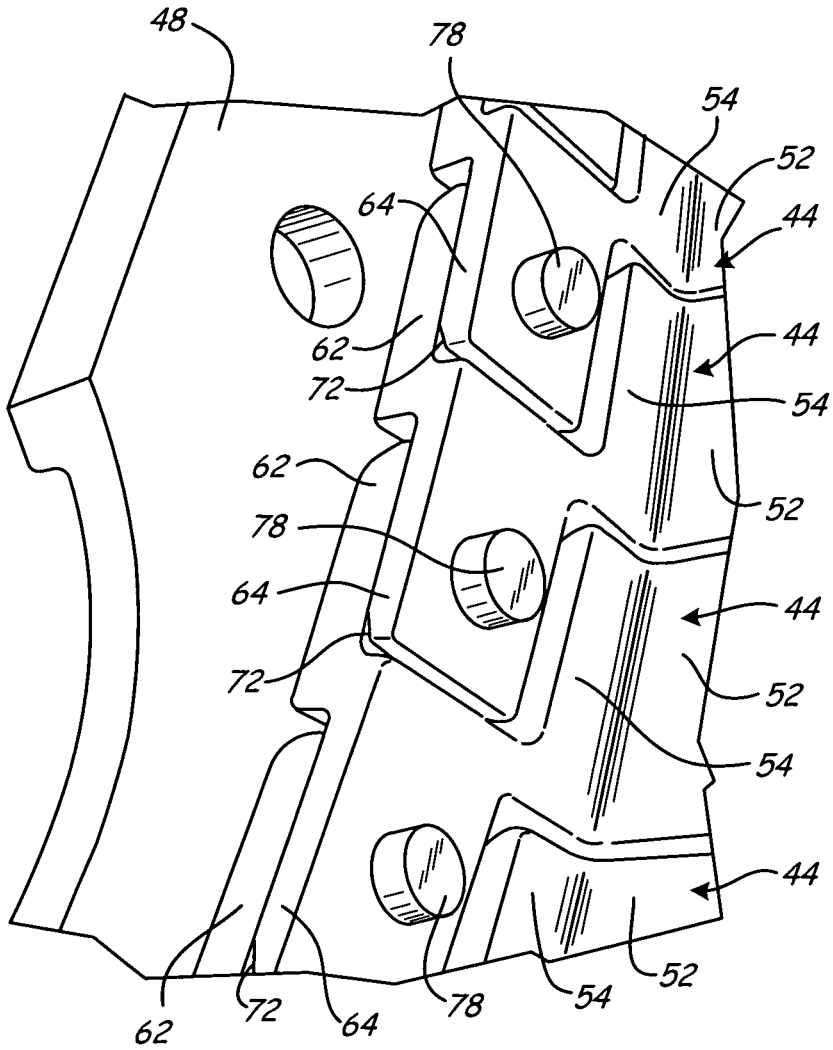
FIG. 7 is a perspective view of a portion of the low pressure compressor exit guide vane assembly at region VII of FIG. 6.

A plurality of vanes 44, as described above with respect to FIGS. 3-5, can be connected together to form the LPC exit guide vane assembly 40 for installation in the gas turbine engine 20. FIG. 6 is a perspective view of the LPC exit guide vane assembly 40 during assembly, and prior to installation in the engine 20, and FIG. 7 is an enlarged perspective view of a portion of the LPC exit guide vane assembly 40 at region VII of FIG. 6. A plurality of the vanes 44 (only some of the vanes 44 are labeled in FIG. 6 for simplicity) are positioned adjacent one another in a cascade configuration, with the airfoil portions 50 spanning an annular gap between the integral platform segments 52 (at the ID flowpath boundary) and the OD shroud ring 42. In order to install the final vane 44 in the assembly, adjacent vanes 44 may need to be at least partially unseated relative to the downstream ring 48 while the last vane 44 is wiggled into position and the adjacent vanes 44 reseated against the downstream ring 48. As mentioned above, the "free" ends (or tips) 58 of the vanes 44 are inserted into slots in the OD shroud ring 42 and potted using a conformable material such as rubber. Temporary fasteners 76 are used to secure the second flange 56 (not visible in FIG. 6) of each vane 44 to the upstream ring 46. The temporary fasteners 76 are systematically removed and replaced by rivets 78 during the assembly process. Rivets 78 are also used to secure the first flange 54 to the downstream ring 48. When all riveted attachments are made, a sealant (e.g., rubber sealant) can be applied between the platforms 52 of adjacent vanes 44, to help reduce fluid leakage at the ID boundary of the primary flowpath 49.

As best shown in FIG. 7, the first flanges 54 of adjacent vanes 44 engage each other in a shiplap joint. The second circumferential extension 64 of the first flange 54 of one vane 44 is positioned adjacent to the first circumferential extension 62 of another vane 44. The aft face of the given second circumferential extension 64 is positioned in the cutaway portion along the forward face of the given first circumferential extension 62 to define a mating plane, with the opening 70 in the second circumferential extension 64 aligned with the opening 68 in the first circumferential extension 62. A rivet 78 positioned through both of the aligned openings 68 and 70 can commonly secure the first flanges 54 of two adjacent vanes 44 to the downstream ring 48.

The configuration of the shiplap joint in the illustrated embodiment, with the first circumferential extension 62 offset so as to be positioned generally aft of the second circumferential extension 64, can help reduce tensile stress in the rivets 78. In the illustrated embodiment, operational loading on the airfoil portion 50 will tend to cause the first circumferential extension 62 to pull away from the downstream ring 48 and the second circumferential extension 64 (located at a suction side of the airfoil portion 50, as best shown in FIG. 5) to push toward the downstream ring 48. The illustrated embodiment of the shiplap joint causes the operational loads transmitted through the second circumferential extensions 64 to offset those transmitted through the first circumferential extensions 62, thereby helping to lessen overall tensile loading on the rivets 78.

The OD shroud ring 42 and the downstream ring 48 each include connection features, such as bayonet mount lugs, bolt holes, etc., to enable the LPC exit guide vane assembly 40 to be mounted and secured within the gas turbine engine 20. In the illustrated embodiment, the downstream ring 48 provides the primary structural support attachment between the assembly 40 and the rest of the engine 20 (see FIG. 2).

When the LPC exit guide vane assembly 40 is assembled in the engine 20, the lip 60 extends downstream (or aft) of the first flange 54, creating an overhang adjacent to the shiplap joint (see FIG. 2) that helps reduce fluid leakage from the primary flowpath 49. In the event of a part liberation event, such as a failure of one of the rivets 78 during engine operation, the lip 60 also helps to contain the liberated part, limiting the risk of the liberated part entering the primary flowpath 49 and causing domestic object damage (DOD).

Should one or more of the vanes 44 of the LPC exit guide vane assembly 40 require repair or replacement, it is possible to remove the rivets 78 (or other fasteners) attaching the selected vane 44 and adjacent vanes 44. The selected vane 44 can be removed or replaced, and then the LPC exit guide vane assembly 40 reassembled in the manner described above with regard to the installation of the last vane in the assembly.

It should be recognized that the present invention provides numerous advantages. For example, vane assemblies having vanes secured at a shiplap joint according to the present invention can be positioned relatively close together, allowing relatively high vane counts. This is particularly advantageous where it is desired to secure vanes with fasteners (e.g., rivets) at ID locations, where space is more limited than at corresponding OD locations. The present invention also places fasteners (e.g., rivets) for securing the vanes away from an engine's primary flowpath, which helps promote aerodynamic efficiency and also helps limit a risk of DOD.

Although the present invention has been described with reference to preferred embodiments, workers skilled in the art will recognize that changes may be made in form and detail without departing from the spirit and scope of the invention. For instance, the present invention can be applied to nearly any vane assembly for a gas turbine engine, and the particular shape and configuration of the airfoil portion, platform, and flanges of each vane can vary as desired for particular applications. Additionally, though the illustrated embodiments depict a shiplap joint at an ID location of a vane assembly, in alternative embodiments of the present invention the shiplap joint can be located at an OD location of the vane assembly.

The invention claimed is:

1. A vane for a gas turbine engine, the vane comprising:

An airfoil portion having first and second ends spaced apart in a radial direction, Wherein the first end of the airfoil portion defines an unshrouded tip;

a platform integrally formed at the second end of the airfoil, wherein the platform is configured to define a flowpath boundary segment; and a first flange extending from the platform away from the airfoil portion substantially in the radial direction, the first flange defining a first circumferential extension and an adjacent second circumferential extension, wherein the first and second circumferential extensions each define forward and aft faces, and wherein the first and second circumferential extensions are offset in an axial direction such that the forward face of the first circumferential extension is substantially aligned with the aft face of the second circumferential extension in the axial direction; and wherein the first circumferential extension joins the platform along an entire side of the first circumferential extension; and wherein the second circumferential extension joins the first circumferential extension in a cantilevered configuration.

2. The vane of claim 1 and further comprising:

a first bolt hole defined in the first circumferential extension.

3. The vane of claim 2 and further comprising:

a second bolt hole defined in the second circumferential extension, wherein the first and second bolt holes are configured to enable connection to an adjacent vane of a similar configuration in a shiplap type joint.

4. The vane of claim 1, wherein the second circumferential extension extends past the platform in a circumferential direction.

5. The vane of claim 1, wherein the first circumferential extension is substantially circumferentially aligned with the platform.

6. The vane of claim 1, wherein the first end of the airfoil portion is configured to be positioned radially outward of the second end in a gas turbine engine.

7. The vane of claim 1, wherein the first flange is integrally formed with the platform.

8. The vane of claim 1 and further comprising:

a second flange extending from the platform away from the airfoil portion.

9. The vane of claim 8, wherein the first flange is located at a downstream edge of the platform, and wherein the second flange is located at an upstream edge of the platform.

10. A vane for a gas turbine engine, the vane comprising:

an airfoil portion having first and second ends spaced apart in a radial direction, wherein the first end of the airfoil portion defines an unshrouded tip;

a platform integrally formed at the second end of the airfoil, wherein the platform is configured to define a flowpath boundary segment; and a first flange integrally formed with the platform and extending substantially radially from the platform away from the airfoil portion, the first flange defining a cutaway portion and an adjacent lobe that extends in a substantially circumferential direction beyond a circumferential edge of the platform, wherein the cutaway portion and the lobe have complementary shapes;

wherein the cutaway portion of the first flange adjoins the platform along an entire side of the cutaway portion; and wherein the adjacent lobe of the first flange adjoins the cutaway portion of the first flange in a cantilevered configuration.

11. The vane of claim 10 and further comprising:

a second flange extending from the platform away from the airfoil portion, wherein the first flange is located at a downstream edge of the platform, and wherein the second flange is located at an upstream edge of the platform.

12. The vane of claim 10 and further comprising:

a first bolt hole defined in the first circumferential extension; and a second bolt hole defined in the second circumferential extension, wherein the first and second bolt holes are configured to enable connection to an adjacent vane of a similar configuration in a shiplap type joint.

13. A vane assembly for a gas turbine engine, the assembly comprising:

a shroud ring having a plurality of openings;

a plurality of vanes each comprising:

an airfoil portion having opposite first and second ends, wherein the first end of the airfoil portion is potted at one of the plurality of openings in the shroud ring;

a platform integrally formed at the second end of the airfoil, wherein the platform defines a segment of a flowpath boundary; and a first flange integrally formed with the platform and extending substantially radially from the platform away from the airfoil portion, the first flange defining a first circumferential extension and an adjacent second circumferential extension, wherein the first and second circumferential extensions are axially offset such that the first circumferential extension of each vane engages the second circumferential extension of an adjacent one of the plurality of vanes to define a shiplap joint; and wherein the first circumferential extension joins the platform along an entire side of the first circumferential extension; and wherein the second circumferential extension joins the first circumferential extension in a cantilevered configuration.

14. The assembly of claim 13, each of the plurality of vanes further comprising:

a first bolt hole defined in the first circumferential extension of the first flange; and a second bolt hole defined in the second circumferential extension of the first flange, wherein the first bolt hole of each vane aligns with the second bolt hole of an adjacent one of the plurality of vanes to mechanically secure the shiplap joint with bolts.

15. The assembly of claim 13, at least one of the plurality of vanes further comprising:

a second flange extending from the platform away from the airfoil portion.

16. The assembly of claim 13, wherein the first flange is located at a downstream edge of the platform, and wherein the second flange is located at an upstream edge of the platform.

17. The assembly of claim 13, wherein the shroud ring is positioned radially outward with respect to the plurality of vanes.

18. The assembly of claim 13, the platform further comprising:

a lip extending downstream beyond the first flange.

* * * * *

UNITED STATES PATENT AND TRADEMARK OFFICE

CERTIFICATE OF CORRECTION

PATENT NO. : 8,511,983 B2
APPLICATION NO. : 12/070466
DATED : August 20, 2013
INVENTOR(S) : Jess A. Weinstein and Kevin C. Eckland It is certified that error appears in the above-identified patent and that said Letters Patent is hereby corrected as shown below:

In the Claims

Col. 5, Line 48
Delete "An"
Insert --an--

Col. 5, Line 49
Delete "Wherein"
Insert --wherein--

Signed and Sealed this
Twelfth Day of November, 2013

Teresa Stanek Rea
*Deputy Director of the United States Patent and Trademark Office*